US008953009B2

(12) United States Patent
Furuta

(10) Patent No.: US 8,953,009 B2
(45) Date of Patent: Feb. 10, 2015

(54) ELECTROPHOTOGRAPHIC IMAGE FORMING APPARATUS AND IMAGE FORMING METHOD

(71) Applicant: Canon Kabushiki Kaisha, Tokyo (JP)

(72) Inventor: Yasutomo Furuta, Abiko (JP)

(73) Assignee: Canon Kabushiki Kaisha (JP)

( * ) Notice: Subject to any disclaimer, the term of this patent is extended or adjusted under 35 U.S.C. 154(b) by 16 days.

(21) Appl. No.: 13/752,603

(22) Filed: Jan. 29, 2013

(65) Prior Publication Data

US 2013/0208068 A1 Aug. 15, 2013

(30) Foreign Application Priority Data

Feb. 10, 2012 (JP) ..... 2012-027238

(51) Int. Cl.

| | |
|---|---|
| ***B41J 2/47*** | (2006.01) |
| ***B41J 2/435*** | (2006.01) |
| ***B41J 2/385*** | (2006.01) |
| ***G03G 15/043*** | (2006.01) |
| ***G03G 13/04*** | (2006.01) |
| ***G03G 15/04*** | (2006.01) |

(52) U.S. Cl.

CPC ..... *G03G 15/043* (2013.01); *G03G 13/04* (2013.01); *G03G 15/04054* (2013.01)

USPC ..... 347/240; 347/251; 347/246; 347/224; 347/236; 347/118

(58) Field of Classification Search

USPC ..... 347/118, 224, 236, 240, 246, 251, 25

See application file for complete search history.

(56) References Cited

U.S. PATENT DOCUMENTS

| | | | | |
|---|---|---|---|---|
| 5,696,842 | A * | 12/1997 | Shirasawa et al. | 382/176 |
| 2009/0135243 | A1* | 5/2009 | Yamazaki | 347/254 |
| 2011/0128344 | A1* | 6/2011 | Horiuchi | 347/224 |
| 2011/0235063 | A1* | 9/2011 | Kondo | 358/1.2 |

FOREIGN PATENT DOCUMENTS

| | | | |
|---|---|---|---|
| JP | 2002-055498 | A | 2/2002 |
| JP | 2002055498 | A * | 2/2002 |

* cited by examiner

*Primary Examiner* — Sarah Al Hashimi

(74) *Attorney, Agent, or Firm* — Rossi, Kimms & McDowell LLP

(57) ABSTRACT

An image forming apparatus using the laser scan method or the LED method, which is capable of reducing a variation of spot diameter with a simple mechanism, and of forming a high-quality image by adjusting the density depending on the image resolution with a low cost. The image forming apparatus forms an image by developing an electrostatic latent image formed by irradiating a charged photoconductor with light emitted from a light source with developer. A detecting unit detects a distance between an attention pixel and an adjacent image that is adjacent to an image including the attention pixel across a white background. An adjustment unit adjusts a density of the attention pixel based on the distance measured with the detecting unit and a spot diameter of the light on a surface of the photoconductor.

6 Claims, 5 Drawing Sheets

*FIG.4*
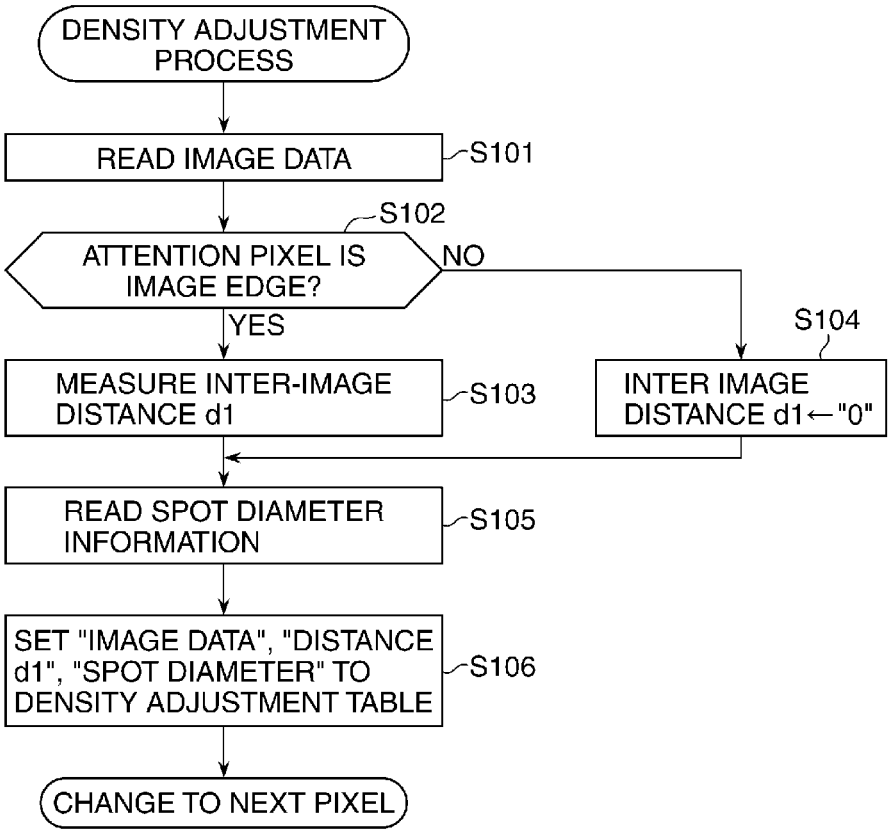
*FIG. 5A* *FIG. 5B*
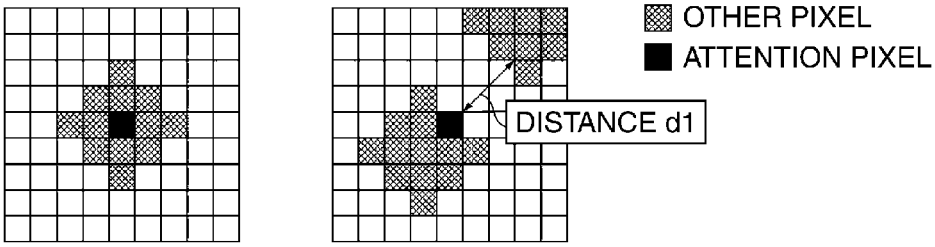

*FIG.6*

| | | INTER-IMAGE DISTANCE (NUMBER OF PIXELS) | | | | | |
|---|---|---|---|---|---|---|---|
| | | 0 | 1 | 2 | 3 | 4 | 5 |
| SPOT DIAMETER ($\mu$m) | 40 | a1 | a2 | a3 | a4 | a5 | a6 |
| | 50 | b1 | b2 | b3 | b4 | b5 | b6 |
| | 60 | c1 | c2 | c3 | c4 | c5 | c6 |
| | 70 | d1 | d2 | d3 | d4 | d5 | d6 |
| | 80 | e1 | e2 | e3 | e4 | e5 | e6 |

ELECTROPHOTOGRAPHIC IMAGE FORMING APPARATUS AND IMAGE FORMING METHOD

BACKGROUND OF THE INVENTION

1. Field of the Invention

The present invention relates to an electrophotographic image forming apparatus that forms an image with an electrophotography system and an image forming method.

2. Description of the Related Art

Some of electrophotographic image forming apparatuses, such as copying machines and printers, use a laser scan method for forming an image by deflecting a laser beam emitted from a laser source for scanning. An optical scanning system using this laser scan method employs a configuration in which a beam emitted from a laser source is deflected by a polygon mirror, and is converged onto a photoconductive drum for scanning through a collimator lens and an f-theta lens, in general.

On the other hand, an image forming apparatus using an LED method for forming an image by LEDs (an LED array) aligned in the longitudinal direction of the photoconductive drum is known. The LED method employs a configuration in which an LED head, which integrates the LED array and a rod lens array for converging lights emitted from the LED array onto the photoconductive drum, is arranged over the photoconductive drum.

In either method, if the positional relationship between the light source and the lens, or the positional relationship between the lens and the photoconductive drum deviates from a predetermined condition, the diameter of the light spot formed on the photoconductive drum increases. For example, if a frame etc. of the image forming apparatus deforms due to heat generated by driving the image forming apparatus, the positional relationship among the light source, the lens, and the photoconductive drum deviates, which changes the light path length between the light source and the photoconductive drum. Thereby, the diameter of the light spot (it is described as "spot diameter") on the photoconductive drum varies.

When the spot diameter increases, light spots overlap over adjacent dots or lines (it is called as "interference of light spots"), which causes problems, such as a variation in a density of a halftone image. Since the distance between the lens and the photoconductive drum in the LED method is shorter than that in the laser scan method, the ratio of the increase in the spot diameter to the change of the distance between the lens and the photoconductive drum is particularly higher in the LED method.

Accordingly, there is a known method of using a mechanical adjustment mechanism that adjusts a distance between an LED head and a photoconductive drum for controlling increase in a spot diameter. On the other hand, Japanese Laid-Open Patent Publication (Kokai) No. 2002-55498 (JP 2002-55498A) discloses a method for detecting state of a light spot based on an image sample to adjust a density of a halftone image according to the state of light spot. This publication describes that the variation in the density of a halftone image due to the increasing spot diameter can be corrected while avoiding cost increase due to an addition of an adjustment mechanism because the method disclosed in this publication does not need to use a mechanical adjustment mechanism.

However, since the method disclosed in JP 2002-55498A adjusts the density of a halftone image by an image process according to the spot diameter, the optimal density adjustment value varies depending on image resolution of image data. Accordingly, there is a problem that the density adjustment remainder remains. Here, a relation among a variation of spot diameter, image resolution, and a density will be described.

In an image like a halftone image in which pixels without data (no-lighting pixels) and pixels with data (lighting pixels) are intermingled, a density tends to vary because exposure area of one pixel varies depending on variation in the spot diameter. Particularly, when the image resolution is high (when a screen ruling is large, for example), the density fluctuation amount due to the variation of spot diameter tends to become large.

FIG. 8A through FIG. 8D are views schematically showing increases of spot diameter due to defocus. FIG. 8A shows dot shapes under the condition where two lighting pixels (light emission points A and B) are positioned with a fixed short distance interval (distance d2) therebetween, and light beams optimally focus to a photoconductive drum (a just focus state). FIG. 8B shows dot shapes of the lighting pixels A and B under the same condition as FIG. 8A when spot diameters increase due to defocus. Since the increases of spot diameters cause an overlap of the dots when the distance between the lighting pixels is short as shown in FIG. 8A and FIG. 8B, an image density under the defocus state shown in FIG. 8B varies significantly as compared with the just focus state shown in FIG. 8A.

FIG. 8C shows dot shapes under the condition where two lighting pixels (light emission points A and B) are positioned with a fixed long distance interval (distance d3) therebetween, and light beams optimally focus to the photoconductive drum (the just focus state). FIG. 8D shows dot shapes of the lighting pixels A and B under the same condition as FIG. 8C when spot diameters increase due to defocus. Here, it is assumed that the distance d3 is longer enough than the distance d2. Since the increases of spot diameters do not cause an overlap of the dots when the distance between the lighting pixels is long as shown in FIG. 8C and FIG. 8D, a density fluctuation amount can be reduced as compared with the case shown in FIG. 8A and FIG. 8B.

For such a reason, the density fluctuation amount generated in response to the variation of spot diameter varies depending on the distance interval between lighting pixels. Particularly, since lighting pixels and no-lighting pixels are positioned with short distance intervals in a halftone image with large screen ruling, the density tends to vary due to the increase in the spot diameters.

Although the apparatus disclosed in JP 2002-55498A switches image processing method based on a determination of whether inputted image data is character/line data or not, there is a problem that the density fluctuation cannot be corrected accurately because the same process is applied to image data regardless of difference in screen ruling. If a system switches a processing method by determining screen ruling and a type of image data, the system needs to provide a circuit for determining the type of image data, and correction tables for the respective types of image data. This complicates and enlarges the circuit, and increases a cost.

SUMMARY OF THE INVENTION

The present invention provides an image forming apparatus and an image forming method using the laser scan method or the LED method, which are capable of reducing a variation of spot diameter with a simple mechanism, and of forming a high-quality image by adjusting the density depending on the image resolution with a low cost.

Accordingly, a first aspect of the present invention provides an image forming apparatus that forms an image by developing an electrostatic latent image formed by irradiating a charged photoconductor with light emitted from a light source with developer, comprising a detecting unit configured to detect a distance between an attention pixel and an adjacent image that is adjacent to an image including the attention pixel across a white background, and an adjustment unit configured to adjust a density of the attention pixel based on the distance measured with the detecting unit and a spot diameter of the light on a surface of the photoconductor.

Accordingly, a second aspect of the present invention provides an image forming method for an image forming apparatus that forms an image by developing an electrostatic latent image formed by irradiating a charged photoconductor with light emitted from a light source with developer, the method comprising measuring a distance between an attention pixel and an adjacent image that is adjacent to an image including the attention pixel across a white background, and adjusting a density of the attention pixel based on the distance detected and a spot diameter of the light on a surface of the photoconductor with an adjustment unit with which the image forming apparatus is provided.

According to the present invention, since the variation of spot diameter of the light emitted from the light source is reduced with a simple mechanism, and the density is adjusted depending on the image resolution, the cost increase of the image forming apparatus is reduced and a high-quality image is formed.

Further features of the present invention will become apparent from the following description of exemplary embodiments with reference to the attached drawings.

BRIEF DESCRIPTION OF THE DRAWINGS

FIG. 4 is a flowchart showing a density adjustment process in the image forming apparatus shown in FIG. 1.

FIG. 5A and FIG. 5B are views schematically showing image arrangements determined in step S102 in FIG. 4.

FIG. 6 is a view showing an example of a density adjustment table established in step S106 in FIG. 4.

DESCRIPTION OF THE EMBODIMENTS

Hereafter, embodiments according to the present invention will be described in detail with reference to the drawings.

This embodiment describes an image forming apparatus of the electrophotography system exposed by an LED head. Particularly, the embodiment describes the image forming apparatus that corrects a light amount of an attention pixel in an image according to spot diameter of light emitted from the LED head in the attention pixel and a distance from the attention pixel to an adjacent pixel (dot or line) across a white background, and that adjusts a density.

Figure 1:
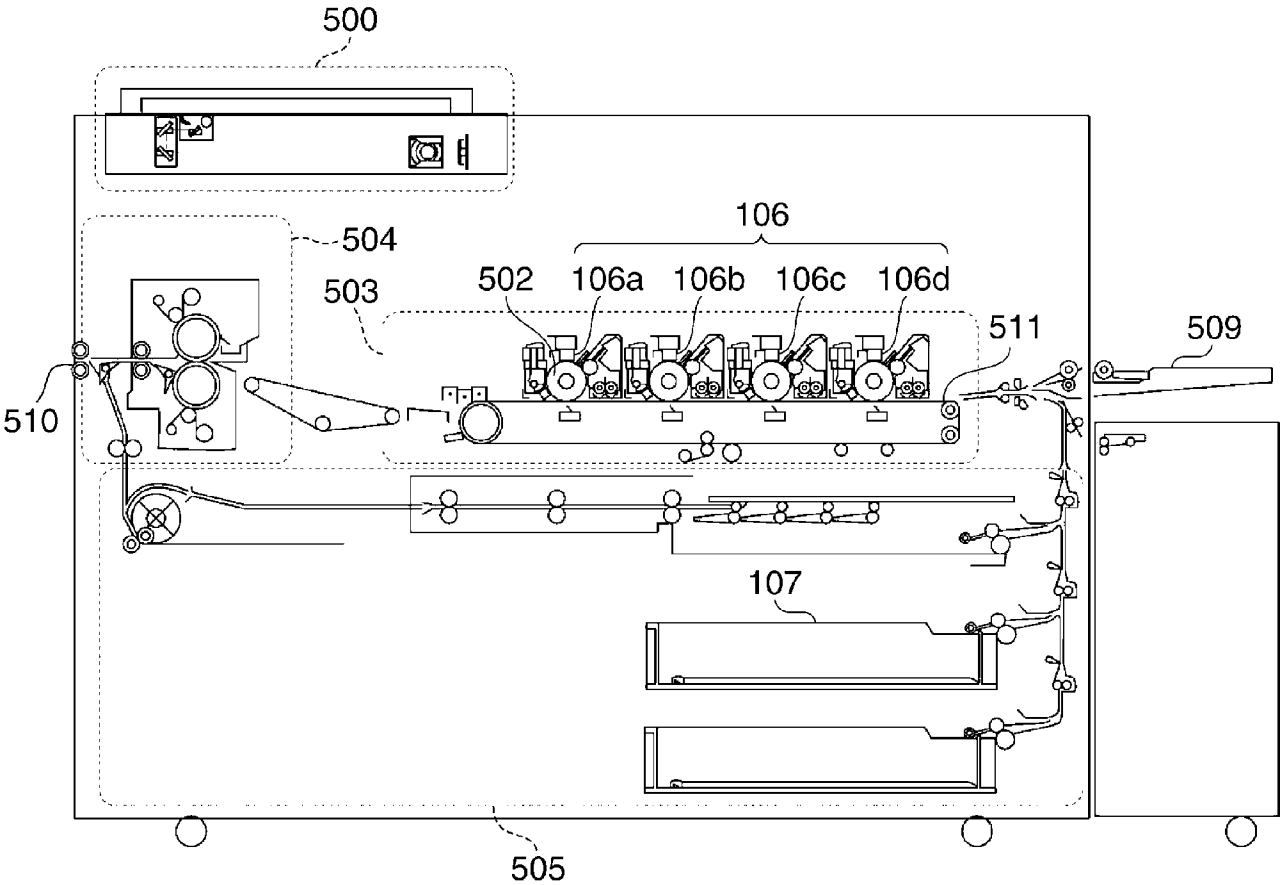
FIG. 1 is a sectional view schematically showing a configuration of an image forming apparatus according to an embodiment of the present invention.

FIG. 1 is a sectional view schematically showing a configuration of the image forming apparatus according to the embodiment of the present invention. This image forming apparatus mainly comprises a scanner unit 500, an image forming unit 503, a fixing unit 504, a feeding/conveyance unit 505, and a control unit (not shown) that controls the entire image forming apparatus.

The scanner unit 500 irradiates an original set on an original bench with light, reads an original image as an optical image by receiving the reflected light, and converts the optical image into an electrical signal to generate image data.

The image forming unit 503 has four-stranded development units for respective colors, i.e., cyan (C), magenta (M), yellow (Y), and black (K). Each development unit has photoconductive drums 502 and LED heads 106 (106*a*, 106*b*, 106*c*, and 106*d*) that are provided for the respective photoconductive drums 502. The LED heads 106*a* through 106*d* have the same configuration, and emit lights in response to image data. The emitted LED lights are condensed by rod lens arrays onto the respective photoconductive drums 502.

In each development unit, the photoconductive drum 502 is rotated and is charged with an electrostatic charger, and a toner image is formed by developing an electrostatic latent image formed on the photoconductive drum 502 with the LED head 106 with toner (developer) of the respective colors. The control unit controls timings of image forming operations in the respective development units so as to transfer the toner images of the respective colors one by one to an intermediate transfer belt 511. As a result, a full-color-toner image without color misregistration is transferred to the intermediate transfer belt 511. It should be noted that small amount of toner remained on the photoconductive drum 502 without being transferred is recovered by a cleaner after transferring the toner image to the intermediate transfer belt 511.

The toner image formed on the intermediate transfer belt 511 is transferred to a sheet (a paper sheet) as a transfer member that is fed from a sheet cassette 107 or a manual-bypass tray 509. The fixing unit 504 is configured by combining rollers and belts, has a heat source like a halogen heater built-in, and fixes the toner image on the sheet by melting the toner image with heat and pressure. Thus, the sheet to which the fixing process was applied is ejected to the outside of the image forming apparatus by an ejecting roller pair 510.

The control unit controls various operations in the image forming apparatus so as to smoothly proceed a series of operations from the reading of an image to the ejection of a sheet to which a toner image is transferred, when a CPU develops programs stored in a ROM onto a RAM and executes them.

Figure 2A:
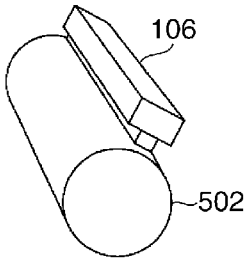
FIG. 2A is a perspective view showing an arrangement of an LED head against a photoconductive drum in the image forming apparatus in FIG. 1.
Figure 2B:
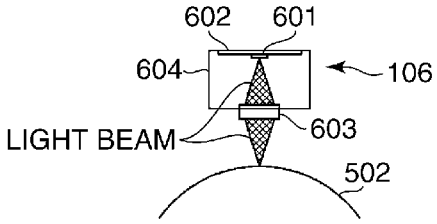
FIG. 2B is a view showing a condensing state of an LED light to the photoconductive drum in the image forming apparatus in FIG. 1.

FIG. 2A is a perspective view showing an arrangement of the LED head 106 against the photoconductive drum 502. FIG. 2B is a view showing a condensing state of the LED light to the photoconductive drum 502. The LED head 106 and the photoconductive drum 502 are attached to a frame (not shown) of the image forming apparatus by attaching members (not shown), respectively. The LED head 106 mainly comprises an LED element group 601, a printed circuit board 602 on which the LED element group 601 is mounted, a rod lens array 603, and a housing 604 that contains the printed circuit board 602 and the rod lens array 603. A LED light emitted from each LED element of the LED element group 601 is condensed with each lens of the rod lens array 603, and is imaged on the surface of the photoconductive drum 502.

Each LED head 106 is assembled and adjusted singly. On the other hand, the rod lens array 603 and the photoconductive drum 502 are arranged so that the distance between the photoconductive drum 502 and the rod lens array 603 is equal to the distance between the rod lens array 603 and the LED element group 601. Even if the attachment position of the rod lens array 603 is adjusted appropriately, the distance between a lens and an LED element has adjustment residual for each LED element due to deformations (distortions) of the print circuit board 602 and the rod lens array 603 and due to variation in a packaging height of the LED element group 601 on the print circuit board 602. This adjustment residual causes variation in a spot diameter. Accordingly, in this embodiment, a spot diameter of light emitted from each LED element is measured after attaching the rod lens array 603 in the LED head 106. Then, the information about the measured spot diameter is stored into a memory 104 (see FIG. 3) in association with the position information about each LED element.

Figure 3:
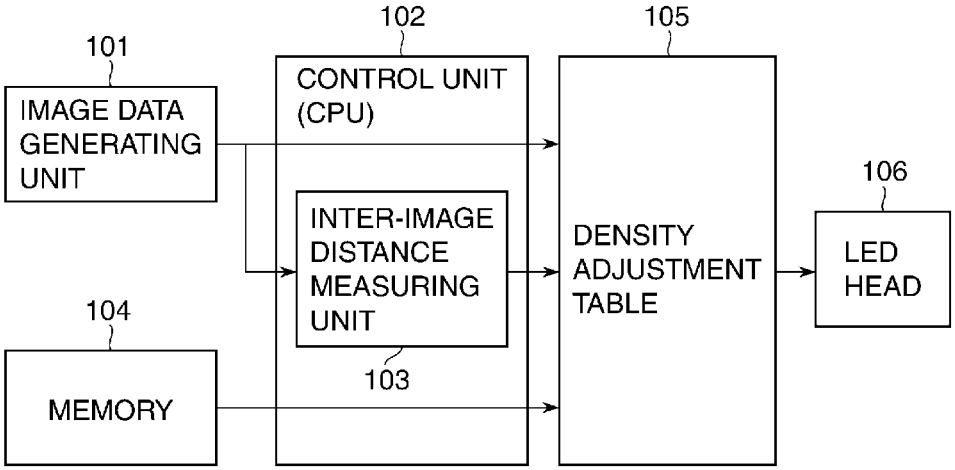
FIG. 3 is a block diagram schematically showing a control system that adjusts a density in the image forming apparatus in FIG. 1.

FIG. 3 is a block diagram schematically showing a control system that adjusts a density in the image forming apparatus. An image data generating unit 101 selects the screen ruling used according to the type of image to print, and performs a screen process. Specifically, the image data generating unit 101 selects the screen ruling based on discriminated results, such as discriminations in characters, lines, and half-tone, and a discrimination of whether the image is a copy image read via the scanner unit 500, and performs the screen process.

A control unit (it is referred to as a "CPU") 102 is provided with an inter-image distance measuring unit 103 that detects a distance (a below-mentioned "inter-image distance d1") between pixels with data (lighting pixels) about the entire image to which the screen process is applied by the image data generating unit 101. It should be noted that the inter-image distance measuring unit 103 is a part of function that the CPU 102 executes, and is a functional block corresponding to the process in steps S102, S103, and S104 in the flowchart in FIG. 4 mentioned later. A density adjustment table 105 is used to convert image data based on the information about the inter-image distance d1 that the inter-image distance detecting unit 103 detected and about the spot diameter, and a concrete example will be described later with reference to FIG. 6.

FIG. 4 is a flowchart showing a density adjustment process. When the CPU 102 instructs the scanner unit 500 to start image formation, the image data of the image read with the scanner unit 500 in response to the instruction is sent to the image data generating part 101. The CPU 102 reads the image data to which the screen process was applied from the image data generating unit 101 (step S101).

The CPU 102 determines whether a pixel (it is referred to as an "attention pixel", hereafter) in a predetermined image area that constitutes the image is an image edge of the image area based on a matrix of image data (step S102). FIG. 5A and FIG. 5B are views schematically showing image arrangements that are subjects of the determination in the step S102. FIG. 5A shows the image arrangement in the case where the attention pixel is not an image edge, and FIG. 5B shows the image arrangement in the case where the attention pixel is an image edge. In the determination in the step S102, when all the pixels adjacent to the attention pixel have data, it is determined that the attention pixel is not an image edge (FIG. 5A). When there is at least one pixel without data (no-lighting pixel) among the pixels adjacent to the attention pixel, it is determined that the attention pixel is an image edge.

When the attention pixel is an image edge (YES in the step S102), the CPU 102 detects the inter-image distance d1 that is a distance between the attention pixel and the adjacent image area nearest to a attention pixel (step S103). Specifically, the CPU 102 takes in the data of pixels surrounding the attention pixel (the data of a nine-by-nine matrix), and extracts the coordinates of lighting pixels and the coordinates of no-lighting pixels among the surrounding pixels. Next, the CPU 102 selects the lighting pixels that are adjacent to the attention pixels across the no-lighting pixels (white background), selects the nearest pixel from among the selected lighting pixels, and calculates the number of pixels between the nearest pixel and the attention pixel as the inter-image distance d1.

In the example in FIG. 5B, since there are two no-lighting pixels between the attention pixel and the adjacent lighting pixel, the inter-image distance d1 is detected as two pixels. When the attention pixel is not an image edge (NO in the step S102), the CPU 102 sets the inter-image distance d1 between the attention pixel and the adjacent image area nearest to the attention pixel as zero (0) (step S104).

After performing the process in the steps S103 and S104, the CPU 102 reads the spot diameter information corresponding to the attention pixel from the memory 104 (step S105). The spot diameter information represents the diameter of light spot formed on the photoconductive drum 502, is measured in an assembly factory of the image forming apparatus, and is stored in the memory 104. In the assembly factory, a profile (light intensity distribution) of the light emitted from the LED head 106 is measured, and the diameter of the region in which the light intensity is more than an arbitrary threshold level is measured as the spot diameter information.

It should be noted that a sensor that measures a spot diameter may be provided inside the body of the image forming apparatus, and a spot diameter may be measured periodically to store into the memory 104. Since the spot diameter information is used as the profile of the light spot formed on the photoconductive drum 502, parameters inputted into the density adjustment table 105 can be simplified, and a configuration can be simplified.

The CPU 102 sets the inter-image distance d1 and the spot diameter information about the image data of the attention pixel in the density adjustment table 105 (step S106), changes the attention pixel to the next pixel, and resumes the process from the step S102. The CPU 102 completes the process shown in the flowchart in FIG. 4 for all the pixels of the image data before the emission of the LED element group 601. Since this enables to adjust the light amount for every pixel, the density can be adjusted more slightly. When the CPU 102 takes long time to the data process, an ASIC having the same function may be provided to measure the inter-image distance d1.

FIG. 6 is a view showing an example of the density adjustment table 105. Since individual density adjustment coefficients are stored corresponding to the inter-image distances d1 as shown in the density adjustment table 105, a suitable density adjustment coefficient corresponding to the inter-image distance d1 is set, which enables the highly precise density adjustment.

For example, when the spot diameter is 40 μm and the inter-image distance d1 is "0", the density adjustment coefficient a1 would be selected and image data is converted according to the ratio of the density adjustment coefficient a1. The density adjustment coefficients a1 through e6 are established according to interference quantity of an image and the characteristic of the image forming apparatus. A coefficient is a ratio of density assuming that the density of the light that is emitted from an LED element and is just focused to the photoconductive drum 502 is "1". For example, when the spot diameter in the just focused state is 40 μm, all the density adjustment coefficients a1 through a6 are set to "1".

In the high density area in an image, the density becomes higher when the spot diameter is larger and the interference quantity with the adjacent image is larger, and the density becomes lower when the spot is smaller and the interference quantity with the adjacent image is smaller. For example, the density adjustment coefficients e1, e2, e3, e4, e5, and e6 under the condition where the spot diameter increases to 80 μm are set to "1.0", "0.8", "0.9", "1.0", "1.1", and "1.2", respectively. In more detail, when the inter-image distance d1 is "0" (zero) (i.e., when the attention pixel is surrounded by the lighting pixels), the density is not adjusted, and accordingly, the density adjustment coefficient e1 is set to "1.0". On the other hand, since the density becomes large due to generation of interference to a no-lighting pixel when the no-lighting pixel locates between lighting pixels, the density adjustment coefficient e2 in the case where the inter-image distance d1 is "1" is set to "0.8" so as to decrease the density. When five no-lighting pixels locate between lighting pixels, there is little interference to the no-lighting pixels, but the density of the circumference of the attention pixel becomes small due to the increase in spot. Accordingly, the density adjustment coefficient e6 in the case where the spot diameter is 80 μm and the inter-image distance d1 is "5" is set to "1.2" so as to increase the density. Thus, the consideration of the interference of the light spot formed on the photoconductive drum 502 for every pixel increases the accuracy of correction and optimizes the density.

Such a density adjustment is executed at the printing timing of the LED head 106 as an exposure device. There is a density adjustment method of performing a data process of changing a density of lighting pixel so that each pixel of the image to which the screen process was applied acquires the image density that is obtained by multiplying the density adjustment coefficient. On the other hand, when a circuit that controls the amount of exposure light by controlling lighting time of the LED head 106 (PWM control) is provided, a method of changing light amount according to a density adjustment coefficient can be used by controlling the emission time of the LED element corresponding to each pixel.

As mentioned above, the image forming apparatus and the image forming method according to this embodiment adjust the density based on the inter-image distance d1 and the spot diameter. Since this adjusts the density according to the inter-image distance d1, the image density is adjusted uniformly regardless of the screen ruling and the image type (a character-lines image, an error diffusion image, etc.), i.e., even if the image resolution differs. Accordingly, a mechanical adjustment mechanism, a complicated image determining function, and a change of contents of process according to the image type are not needed. Thus, since the density can be adjusted accurately with a simple configuration, the image forming apparatus can be configured cheaply.

Although the embodiments of the invention have been described, the present invention is not limited to the above-mentioned embodiments, the present invention includes various modifications as long as the concept of the invention is not deviated.

Figure 7:
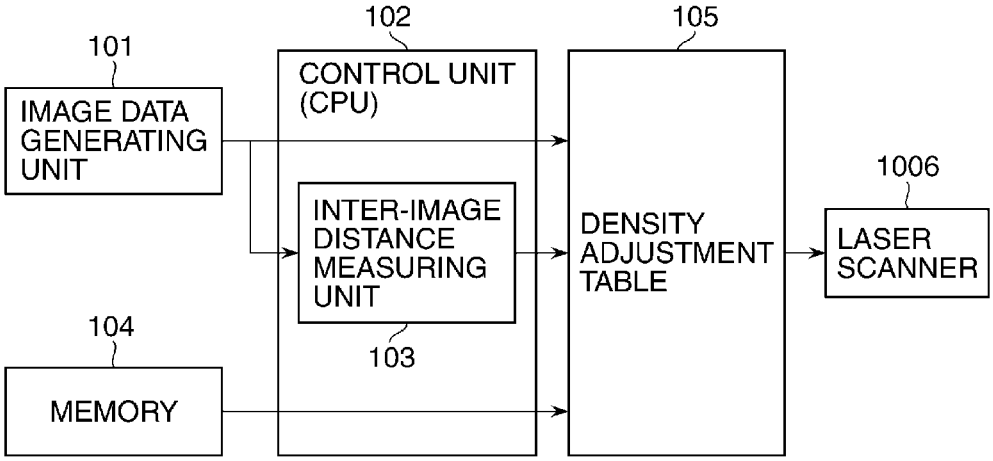
FIG. 7 is a block diagram schematically showing a control system that adjusts a density in an image forming apparatus according to a second embodiment of the present invention.
Figure 8A:
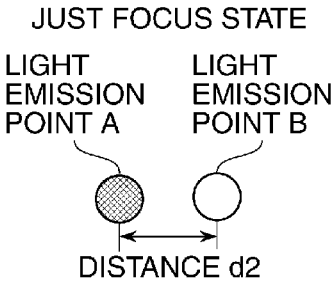
FIG. 8A through FIG. 8D are views showing increases in spot diameter due to defocus.
Figure 8B:
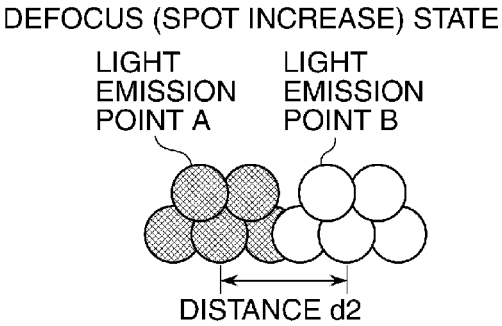
Figure 8C:
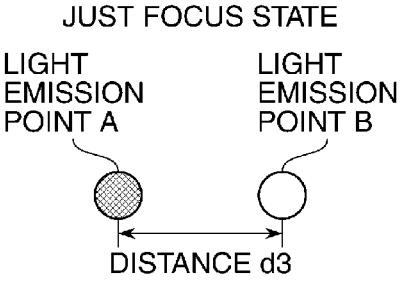
Figure 8D:
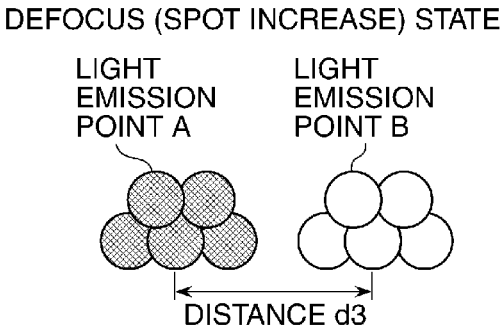

For example, although the present invention is applied to the image forming apparatus that has the exposure device including the LED head 106 as a light source in the above-mentioned embodiment, the present invention is applicable to an image forming apparatus including a laser scan exposure device as shown in FIG. 7. FIG. 7 is a block diagram schematically showing a control system that adjusts density in the image forming apparatus according to a second embodiment of the present invention. FIG. 7 is shown in the same condition as FIG. 3. The image forming apparatus shown in FIG. 7 can stabilize an image density by controlling emission of a laser scanner 1006 instead of the LED head 106 as with the above-mentioned embodiment.

Although the above-mentioned embodiment selects the density adjustment coefficient based on the spot diameter and the inter-image distance d1, and adjusts the density, the present invention is not limited to this. The density adjustment coefficients may be established in individual tables corresponding to the image densities. In such a case, since the density tends to decrease as the spot diameter increases in a low density area, a large value is set to the density adjustment coefficient, for example. Since the density tends to increase as the spot diameter increases in a high density area, a small value is set to the density adjustment coefficient.

Furthermore, the above-mentioned embodiment describes the density adjustment method by converting the image data, the density may be adjusted by controlling the peak light amount of the LED element based on the spot diameter and the inter-image distance d1.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-027238, filed on Feb. 10, 2012, which is hereby incorporated by reference herein in its entirety.

What is claimed is:

1. An image forming apparatus that forms an image by developing an electrostatic latent image formed by irradiating a charged photoconductor with light emitted from a light source with developer, comprising:

a detecting unit configured to detect a distance between an attention pixel and an adjacent image that is adjacent to an image including the attention pixel across a white background; and an adjustment unit configured to adjust a density of the attention pixel based on the distance measured with said detecting unit and a spot diameter of the light on a surface of the photoconductor, wherein said detecting unit determines whether the attention pixel is an edge pixel of the image including the attention pixel, and wherein said detecting unit detects the number of pixels between the attention pixel and the adjacent image as the distance when the attention pixel is the edge pixel, and sets the distance to zero when the attention pixel is not an edge pixel.

2. The image forming apparatus according to claim 1, wherein said adjustment unit has a density adjustment table in which density adjustment coefficients are defined corresponding to the distance measured with said detecting unit and the spot diameter, and adjusts the density of the attention pixel according to the density adjustment table.

3. The image forming apparatus according to claim 2, wherein said adjustment unit sets the density adjustment table so that the density adjustment coefficient increases as the spot diameter increases, and so that the density adjustment coefficient decreases as the distance increases.

4. The image forming apparatus according to claim 2, wherein said adjustment unit performs a data process of changing a density of pixel with data in the image data so that the attention pixel acquires the image density that is obtained by multiplying the density adjustment coefficient.

5. The image forming apparatus according to claim 2, wherein said adjustment unit adjusts the density of the attention pixel by controlling the emission time of the light source so that the attention pixel acquires the image density that is obtained by multiplying the density adjustment coefficient.

6. The image forming apparatus according to claim 2, wherein said adjustment unit adjusts the density of the attention pixel by controlling the peak light amount of the light source so that the attention pixel acquires the image density that is obtained by multiplying the density adjustment coefficient.

* * * * *